US011029623B2

(12) United States Patent
Kubo et al.

(10) Patent No.: US 11,029,623 B2
(45) Date of Patent: Jun. 8, 2021

(54) POWDER AMOUNT DETECTOR INCLUDING A PAIR OF MEASURING ELECTRODES

(71) Applicants: Tatsuya Kubo, Kanagawa (JP); Junichi Matsumoto, Kanagawa (JP); Shuntaroh Tamaki, Kanagawa (JP); Hiroaki Okamoto, Kanagawa (JP)

(72) Inventors: Tatsuya Kubo, Kanagawa (JP); Junichi Matsumoto, Kanagawa (JP); Shuntaroh Tamaki, Kanagawa (JP); Hiroaki Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/914,720

(22) Filed: Jun. 29, 2020

(65) Prior Publication Data

US 2021/0033997 A1 Feb. 4, 2021

(30) Foreign Application Priority Data

Jul. 31, 2019 (JP) ..... JP2019-141155

(51) Int. Cl.
*G03G 15/00* (2006.01)
*G03G 15/08* (2006.01)
*G03G 21/20* (2006.01)

(52) U.S. Cl.
CPC ..... *G03G 15/0856* (2013.01); *G03G 21/203* (2013.01)

(58) Field of Classification Search
USPC ..... 399/44
See application file for complete search history.

(56) References Cited

U.S. PATENT DOCUMENTS 5,465,619 A * 11/1995 Sotack ..... G01F 23/265 118/694
10,429,770 B2 * 10/2019 Kumiya ..... G03G 15/161
10,599,064 B2 * 3/2020 Yamashita ..... G03G 15/0865
2012/0230707 A1 * 9/2012 Shigehiro ..... G03G 15/556 399/27
2016/0097993 A1 * 4/2016 Shinohara ..... G03G 15/086 399/27
2016/0131990 A1 * 5/2016 Kanazawa ..... G03G 15/086 399/27
2017/0363987 A1 12/2017 Nodera et al.
2019/0064699 A1 2/2019 Nodera et al.
2020/0033751 A1 * 1/2020 Matsumoto ..... G03G 15/086

FOREIGN PATENT DOCUMENTS

JP 11-230815 8/1999
JP 2001-121681 5/2001
JP 2016-071299 5/2016

* cited by examiner

*Primary Examiner* — Q Grainger
(74) *Attorney, Agent, or Firm* — Oblon, McClelland, Maier & Neustadt, L.L.P.

(57) ABSTRACT

A powder amount detector detects an amount of powder in a powder container of a cylindrical shape arranged horizontally. The powder amount detector includes a pair of measuring electrodes configured to detect capacitance between the pair of measuring electrodes to detect the amount of powder. The pair of measuring electrodes is disposed around the powder container. One of the pair of measuring electrodes has a flat shape, and the other of the pair of measuring electrodes has an arc shape following a shape of the powder container.

14 Claims, 6 Drawing Sheets

POWDER AMOUNT DETECTOR INCLUDING A PAIR OF MEASURING ELECTRODES

CROSS-REFERENCE TO RELATED APPLICATION

This patent application is based on and claims priority pursuant to 35 U.S.C. § 119(a) to Japanese Patent Application No. 2019-141155, filed on Jul. 31, 2019, in the Japan Patent Office, the entire disclosure of which is hereby incorporated by reference herein.

BACKGROUND

Technical Field

Embodiments of the present disclosure generally relate to a powder amount detector, a powder supply device, and an image forming apparatus.

Description of the Related Art

There is known a powder amount detector, which includes a pair of electrodes, configured to detect an amount of powder in a powder container based on capacitance between the pair of electrodes.

SUMMARY

Embodiments of the present disclosure describe an improved powder amount detector that detects an amount of powder in a powder container of a cylindrical shape arranged horizontally. The powder amount detector includes a pair of measuring electrodes configured to detect capacitance between the pair of measuring electrodes to detect the amount of powder. The pair of measuring electrodes is disposed around the powder container. One of the pair of measuring electrodes has a flat shape, and the other of the pair of measuring electrodes has an arc shape following a shape of the powder container.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
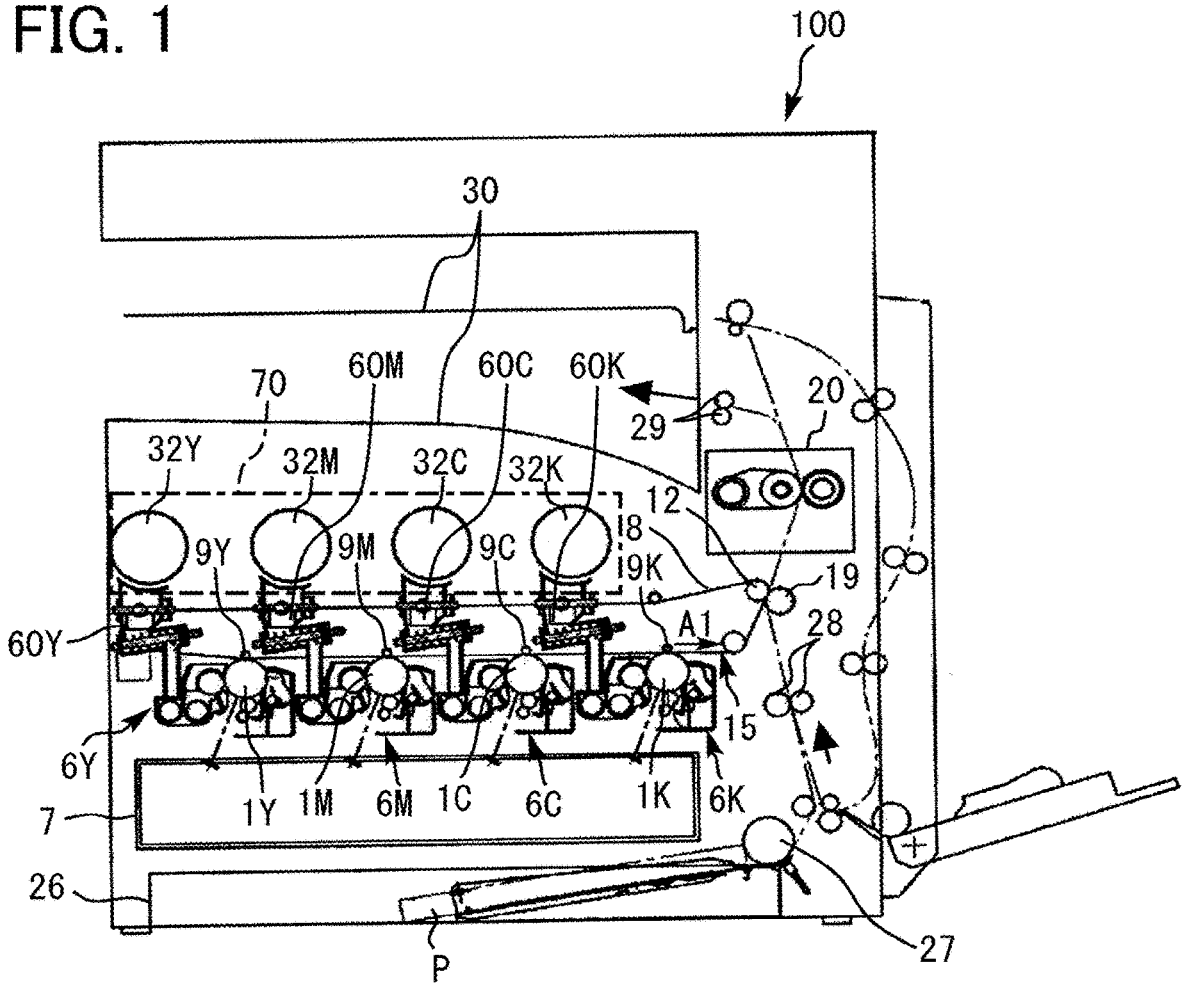
FIG. 1 is a schematic view of a printer as an example of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views, and redundant descriptions are omitted or simplified below as required.

DETAILED DESCRIPTION

Descriptions are given of embodiments of the present disclosure with reference to the drawings.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a schematic view of a printer 100 as an example of an image forming apparatus according to the present embodiment. The printer 100 includes a toner container mount 70. Four replaceable toner containers 32Y, 32M, 32C, and 32K as powder containers (also collectively referred to as the "toner containers 32") to contain yellow, magenta, cyan, and black toners, respectively, are removably installed in the toner container mount 70. Below the toner container mount 70, an intermediate transfer unit 15 is disposed. Four image forming units 6Y, 6M, 6C, and 6K (also collectively referred to as the "image forming units 6") are arranged in parallel, facing an intermediate transfer belt 8 of the intermediate transfer unit 15 to form yellow, magenta, cyan, and black (Y, M, C, and K) toner images, respectively. Toner supply devices 60Y, 60M, 60C, and 60K as powder (developer) supply devices (also collectively referred to as the "toner supply devices 60") are disposed below the toner containers 32Y, 32M, 32C, and 32K, respectively. The toner supply devices 60Y, 60M, 60C, and 60K supply toners contained in the corresponding toner containers 32Y, 32M, 32C, and 32K to developing devices 5 (see FIG. 2), in which the toner as powder is used, of the corresponding image forming units 6Y, 6M, 6C, and 6K.

The four toner containers 32Y, 32M, 32C, and 32K, the four image forming units 6Y, 6M, 6C, and 6K, and the four toner supply devices 60Y, 60M, 60C, and 60K have similar configurations except for the color of toner used therein. Accordingly, in the description and drawings below, the suffixes Y, M, C, and K, each representing the color of toner, are omitted unless color discrimination is necessary.

Figure 2:
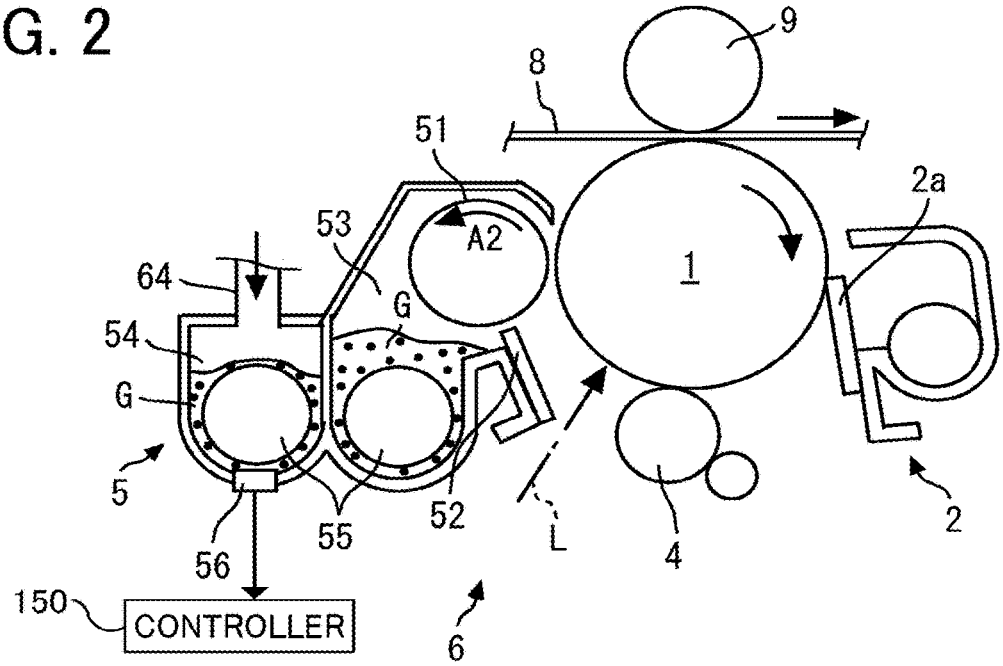
FIG. 2 is a schematic view of one of four image forming units included in the printer in FIG. 1.

FIG. 2 is a schematic view illustrating the configuration of one of the four image forming units 6. Each image forming unit 6 includes a photoconductor 1 as an image bearer, and further includes a charging device 4, the developing device 5, a cleaning device 2, a discharge device, and the like disposed around the photoconductor 1. Image forming processes, namely charging, exposure, development, transfer, and cleaning processes, are performed on the photoconductor 1, and thus a toner image of each color is formed on the photoconductor 1.

The photoconductor 1 rotates clockwise in FIG. 2, driven by a drive motor. At the charging device 4, the surface of the photoconductor 1 is uniformly charged (charging process). When the surface of the photoconductor 1 reaches a position where the surface of the photoconductor 1 is irradiated with a laser beam L emitted from an exposure device 7 (see FIG. 1), the photoconductor 1 is scanned with the laser beam L, and thus an electrostatic latent image for each color is formed thereon (exposure process). Then, the surface of the photoconductor 1 reaches a position opposite the developing device 5, where the electrostatic latent image is developed with toner into the toner image for each color (development process). At a primary transfer position at which the photoconductor 1 is opposed to a primary transfer roller 9 via the intermediate transfer belt 8, the toner image on the photoconductor 1 is transferred onto the intermediate transfer belt 8 (primary transfer process). The respective toner images formed on the photoconductors 1Y, 1M, 1C, and 1K (see FIG. 1) are sequentially transferred to and superimposed on the intermediate transfer belt 8, thereby forming a multicolor toner image on the intermediate transfer belt 8.

After the primary transfer process, a certain amount of untransferred toner remains on the surface of the photoconductor 1. When the surface of the photoconductor 1 reaches a position opposite the cleaning device 2, a cleaning blade 2*a* of the cleaning device 2 mechanically collects the untransferred toner remaining on the photoconductor 1 (cleaning process). Subsequently, the surface of the photoconductor 1 reaches a position opposite the discharge device, and the discharge device removes any residual potential on the photoconductor 1.

The intermediate transfer unit 15 includes the intermediate transfer belt 8, four primary transfer rollers 9Y, 9M, 9C, and 9K, a secondary transfer backup roller 12, multiple tension rollers, and a belt cleaning device. The intermediate transfer belt 8 is stretched around and supported by the above-described multiple rollers and is rotated counterclockwise in FIG. 1 as the secondary transfer backup roller 12, which is one of the multiple rollers, rotates. The four primary transfer rollers 9Y, 9M, 9C, and 9K press against the corresponding photoconductors 1Y, 1M, 1C, and 1K (also collectively referred to as the "photoconductors 1") via the intermediate transfer belt 8, thereby forming primary transfer nips between the primary transfer rollers 9Y, 9M, 9C, and 9K and the corresponding photoconductors 1Y, 1M, 1C, and 1K.

A transfer bias opposite in polarity to toner is applied to each of the primary transfer rollers 9Y, 9M, 9C, and 9K. The intermediate transfer belt 8 rotates in the direction indicated by arrow A1 in FIG. 1 and sequentially passes through the primary transfer nips of the primary transfer rollers 9Y, 9M, 9C, and 9K. Thus, the single-color toner images on the respective photoconductors 1Y, 1M, 1C, and 1K are primarily transferred to and superimposed on the intermediate transfer belt 8, thereby forming a multicolor toner image.

The intermediate transfer belt 8 carrying the multicolor toner image reaches a position opposite a secondary transfer roller 19. The secondary transfer backup roller 12 and the secondary transfer roller 19 press against each other via the intermediate transfer belt 8, and the contact portion therebetween is hereinafter referred to as a secondary transfer nip. The multicolor toner image on the intermediate transfer belt 8 is transferred onto a recording medium P such as a transfer sheet conveyed to the secondary transfer nip (secondary transfer process). After the secondary transfer process, a certain amount of untransferred toner, which is not transferred to the recording medium P, remains on the intermediate transfer belt 8. When the intermediate transfer belt 8 reaches a position opposite the belt cleaning device, the untransferred toner is collected from the intermediate transfer belt 8 by the belt cleaning device to complete a series of transfer processes performed on the intermediate transfer belt 8.

The recording medium P is conveyed from a sheet feeding tray 26 disposed in a lower portion of the printer 100 to the secondary transfer nip via a sheet feeding roller 27 and a registration roller pair 28. More specifically, the sheet feeding tray 26 contains multiple recording media P piled one on another. As the sheet feeding roller 27 rotates counterclockwise in FIG. 1, the sheet feeding roller 27 feeds a top recording medium P in the sheet feeding tray 26 to a roller nip between the registration roller pair 28. The registration roller pair 28 stops rotating temporarily, stopping the recording medium P with a leading edge of the recording medium P nipped in the registration roller pair 28. Then, the registration roller pair 28 rotates to convey the recording medium P to the secondary transfer nip, timed to coincide with the arrival of the multicolor toner image on the intermediate transfer belt 8. Thus, the multicolor toner image is transferred onto the recording medium P.

The recording medium P onto which the multicolor toner image is transferred at the secondary transfer nip is conveyed to a fixing device 20. In the fixing device 20, a fixing belt and a pressure roller apply heat and pressure to the recording medium P to fix the multicolor toner image on the recording medium P. Subsequently, the recording medium P is ejected by an output roller pair 29 to the exterior of the printer 100. The ejected recording media P are sequentially stacked as output images on a stack tray 30 to complete a sequence of image forming processes performed in the printer 100.

Next, the configuration and operation of the developing device 5 of the image forming unit 6 are described in further detail below. As illustrated in FIG. 2, the developing device 5 includes a developing roller 51 disposed opposite the drum-shaped photoconductor 1, a doctor blade 52 disposed opposite the developing roller 51, and two conveying screws 55 respectively disposed in a first developer containing compartment 53 and a second developer containing compartment 54. The developing device 5 further includes a toner concentration sensor 56 to detect a concentration of toner in a developer G in the second developer containing compartment 54. The developing roller 51 includes stationary magnets therein, a sleeve that rotates around the magnets, and the like. The first and second developer containing compartments 53 and 54 contain the two-component developer G including carrier and toner. The second developer containing compartment 54 communicates, via an opening on an upper side thereof, with a downward toner passage 64.

The sleeve of the developing roller 51 rotates counterclockwise as indicated by arrow A2 in FIG. 2. The developer G is carried on the developing roller 51 by a magnetic field generated by the magnets. As the sleeve rotates, the developer G moves along a circumference of the developing roller 51. The percentage (concentration) of toner in the developer G (ratio of toner to carrier) in the developing device 5 is adjusted within a predetermined range. More specifically, the toner supply device 60 (see FIG. 3A) supplies toner from the toner container 32 to the second developer containing compartment 54 according to the consumption of the toner in the developing device 5. The configuration and operation of the toner supply device 60 are described in detail later.

The two conveying screws 55 stir and mix the developer G with the toner supplied to the second developer containing compartment 54 while circulating the developer G in the first and second developer containing compartments 53 and 54. The toner in the developer G is triboelectrically charged by friction with the carrier and electrostatically attracted to the carrier. Then, the toner is carried on the developing roller 51 together with the carrier by magnetic force generated on the developing roller 51. The developer G on the developing roller 51 is carried in the direction indicated by arrow A2 in FIG. 2 to the doctor blade 52.

An amount of developer G on the developing roller 51 is adjusted by the doctor blade 52. Then, the developer G is carried to a development range opposite the photoconductor 1, and toner in the developer G is attracted to the latent image on the photoconductor 1 by an electric field generated in the development range. Subsequently, as the sleeve rotates, the developer G remaining on the developing roller 51 reaches an upper portion of the first developer containing compartment 53 and separates from the developing roller 51.

Figure 3A:
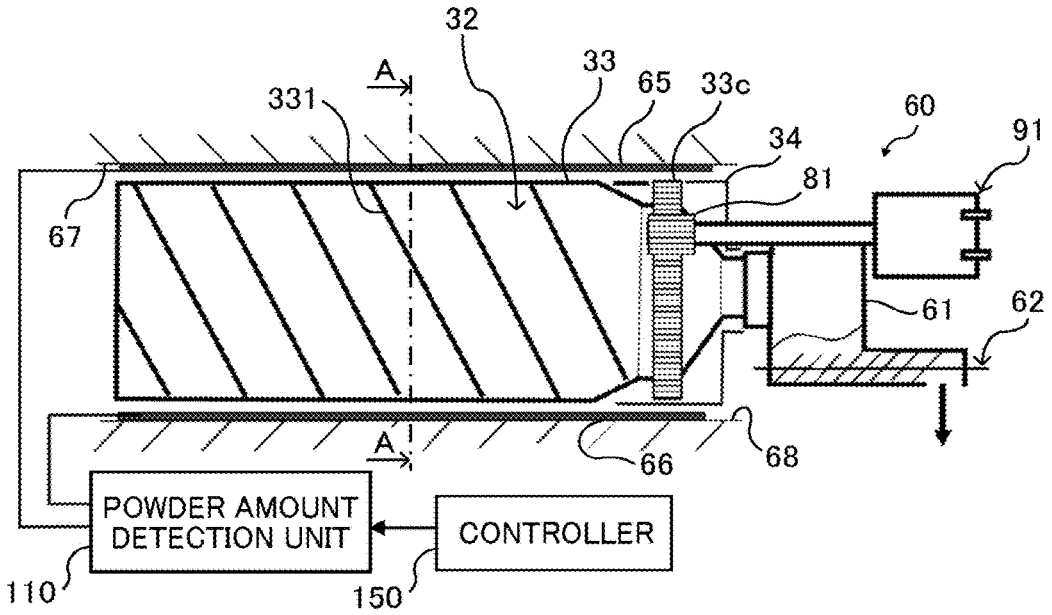
FIGS. 3A and 3B are schematic views of one of four toner supply devices included in the printer in FIG. 1.
Figure 3B:
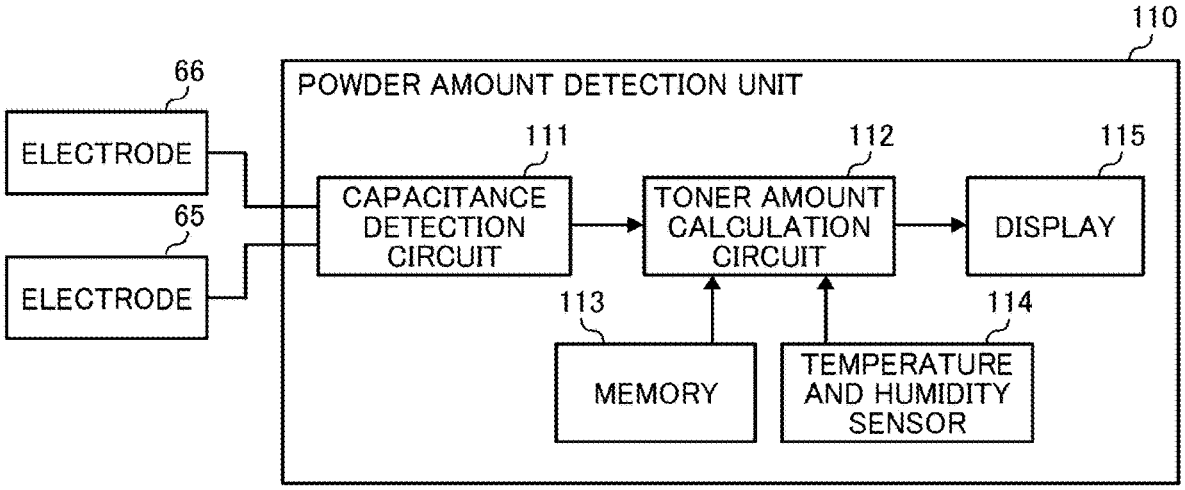
Figure 4:
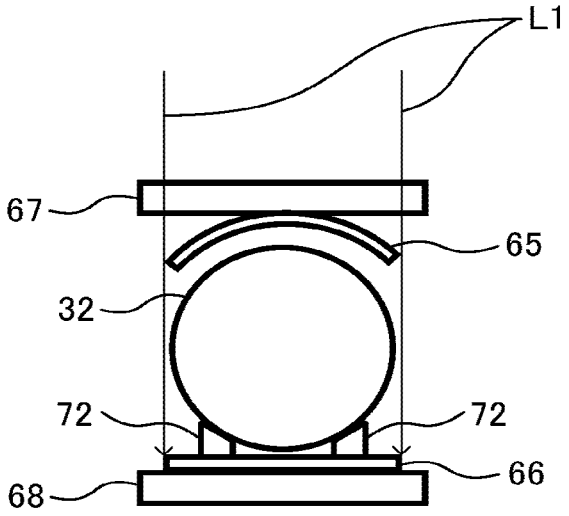
FIG. 4 is a cross-sectional view along line A-A in FIG. 3A.
Figure 5:
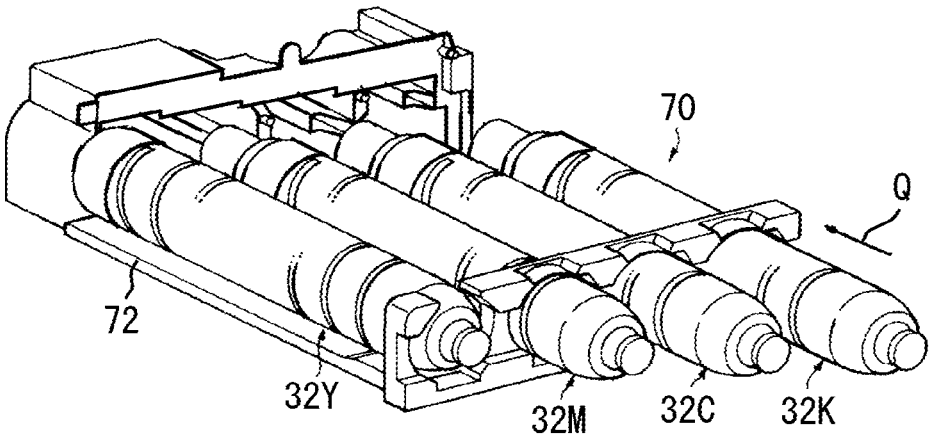
FIG. 5 is a perspective view of toner containers installed in a toner container mount of the printer in FIG. 1.

Next, the toner supply device 60 and the toner container 32 are described in further detail. FIGS. 3A and 3B are schematic views of one of the four toner supply devices 60. FIG. 4 is a cross-sectional view along line A-A in FIG. 3. FIG. 5 is a perspective view of toner containers 32Y, 32M, 32C, and 32K installed in the toner container mount 70. The respective color toners in the toner containers 32 installed in the toner container mount 70 of the printer 100 are supplied to the corresponding developing devices 5 by the toner supply devices 60 provided for the respective color toners according to an amount of toner consumption in the developing devices 5.

The toner containers 32 are inserted into the toner container mount 70 of the printer 100 in the direction indicated by arrow Q in FIG. 5, thereby installing the toner containers 32 in the toner container mount 70. The toner container 32 is supported by two guides 72 illustrated in FIG. 4. The toner container 32 is substantially cylindrical and mainly includes a cap 34 held stationary by the toner container mount 70 so as not to rotate and a container body 33 formed together with a gear 33*c*. The container body 33 is rotatably supported so as to rotate relative to the cap 34, and the gear 33*c* meshes with an output gear 81 of the toner supply device 60. As a drive motor 91 rotates the output gear 81, driving force is transmitted to the gear 33*c* of the container body 33, and the container body 33 is rotated while the guides 72 guide an outer circumference of the container body 33. The drive motor 91, the output gear 81, the gear 33*c*, and the like construct a rotary drive device.

The container body 33 includes a helical rib 331 protruding inward from an inner circumference face of the container body 33. As the container body 33 rotates, the helical rib 331 conveys toner in the container body 33 from the container rear end to the container front end (from the left to the right in FIG. 3A) in a longitudinal direction of the container body 33. The conveyed toner is discharged from the toner container 32 and supplied to a hopper 61 of the toner supply device 60. That is, the drive motor 91 rotates the container body 33 of the toner container 32 as required, thereby supplying the toner to the hopper 61. The toner containers 32Y, 32M, 32C, and 32K are replaced with new ones when the respective service lives thereof have expired, that is, when almost all toner contained in the toner container 32 has been depleted.

As illustrated in FIG. 3A, the toner supply device 60 includes the toner container 32, the toner container mount 70 (see FIG. 5), the hopper 61, a toner conveying screw 62, and the rotary drive device including the drive motor 91. The hopper 61 stores the toner supplied from the toner container 32, and the toner conveying screw 62 is disposed in the hopper 61.

A controller 150 (see FIG. 2) controls various operations in the printer 100, for example, toner supply, toner amount detection, toner concentration adjustment, and the like. As the controller 150 detects that a toner concentration in the developing device 5 has decreased based on a detection result obtained by the toner concentration sensor 56 (see FIG. 2), the controller 150 causes the toner conveying screw 62 to rotate in a predetermined period, thereby supplying the toner to the developing device 5. Since the toner conveying screw 62 is rotated to supply toner, the amount of toner supplied to the developing device 5 can be calculated accurately by detecting the number of rotations of the toner conveying screw 62.

The toner end sensor is disposed on a side wall of the hopper 61 and detects that the amount of toner stored in the hopper 61 has fallen below a predetermined amount. For example, a piezoelectric sensor can be used as the toner end sensor. As the toner end sensor detects that the amount of toner stored in the hopper 61 has fallen below the predetermined amount, the drive motor 91 is driven. As a result, the container body 33 of the toner container 32 is rotated in the predetermined period, thereby supplying toner to the hopper 61. In the present embodiment, the hopper 61 stores toner discharged from the toner container 32, but alternatively, toner discharged from the toner container 32 may be directly supplied to the developing device 5.

In certain image forming apparatuses, an amount of toner remaining in a toner container is estimated and reported to a user. A method to estimate the amount of toner remaining in the toner container is based on cumulative drive duration of a toner conveying screw. Since an amount of toner conveyed by the toner conveying screw is approximately proportional to a rotation angle (a rotation duration), an amount of toner usage can be calculated based on a record of the total rotation duration of the toner conveying screw. Therefore, the amount of toner remaining in the toner container can be calculated by subtracting the amount of toner usage from an initial amount of toner filling the toner container. However, since the amount of toner conveyed by the toner conveying screw varies depending on the environment, drive duration, supply frequency (supply interval), and the like, the estimated value of the amount of toner remaining in the toner container also varies.

Another method to estimate the amount of toner remaining in the toner container is based on an output image pattern. An amount of toner usage to output a printed image can be calculated because an amount of toner adhering to a photoconductor per image area is approximately constant. Therefore, the amount of toner usage can be calculated based on a cumulative image area. However, with this method, it is difficult to accurately estimate the amount of toner remaining in the toner container because the amount of toner adhering to the photoconductor varies due to various errors.

In a comparative example of a toner amount detector, electrodes are disposed on an upper and a lower inner walls of a box-shaped toner container, and the amount of toner remaining in the toner container is estimated by measuring capacitance corresponding to an amount of toner. However, toner may adhere to the electrodes because the electrodes are disposed on the inner walls of the toner container, and the toner is not removed by light force such as vibration and remains on the electrodes. If a lot of toner adheres to the electrodes under certain environmental conditions, for example, a false detection may occur that toner still remains in the toner container even though, in fact, the toner in the toner container is depleted.

In another comparative example, a cylindrical ink container to store ink that is liquid rather than powder is arranged such that a discharge port disposed on one end of the ink container in the longitudinal direction faces vertically downward. An amount of the ink is detected based on change of capacitance between two electrodes. The two electrodes have a curved shape along the side face of the ink container. However, if this structure is directly applied to a powder amount detector, toner as powder may clog the discharge port under gravity, thereby preventing the toner from being discharged.

In the present embodiment, as illustrated in FIGS. 3A and 4, a pair of measuring electrodes 65 and 66 is arranged below and above the toner container 32 in the vertical direction to detect capacitance between the measuring electrodes 65 and 66. The toner container 32 has a cylindrical shape and is arranged horizontally. The measuring electrodes 65 and 66 are not attached to the toner container 32, but are attached to walls 67 and 68 of the printer 100. Since the measuring electrodes 65 and 66 are disposed around the toner container 32, toner is prevented from adhering to the measuring electrodes 65 and 66. In FIG. 4, toner in the toner container 32 is discharged from the lower side of the toner container 32 as the toner container 32 rotates counterclockwise.

In the present embodiment, one of the pair of measuring electrodes 65 and 66, that is, the upper measuring electrode 65 has an arc shape following the shape of the toner container 32. The other measuring electrode 66, which is the lower measuring electrode 66, has a flat shape. In another embodiment, the shapes of the measuring electrodes 65 and 66 may be inverted. That is, the upper measuring electrode 65 may have the flat shape, and the lower measuring electrode 66 may have the arc shape following the shape of the toner container 32. The measuring electrodes 65 and 66 are secured to the walls 67 and 68 of the printer 100 with double-sided tape or the like, respectively. The measuring electrodes 65 and 66 are made of any conductive material, for example, iron plate. The projected areas of the upper and lower measuring electrodes 65 and 66 projected onto the horizontal plane by projection light L1 directed in the vertical direction have the same size, but are not limited thereto.

Figure 6A:
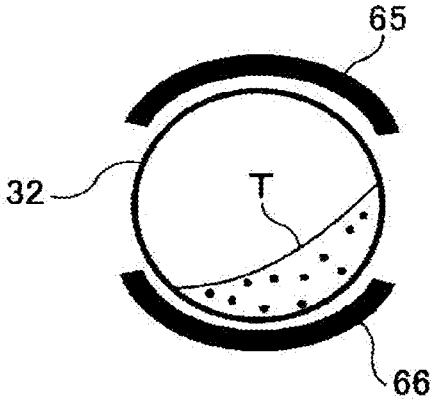
FIGS. 6A and 6B are schematic cross-sectional views of the toner container and a pair of arc-shaped electrodes to illustrate shortcomings of the arc shape.
Figure 6B:
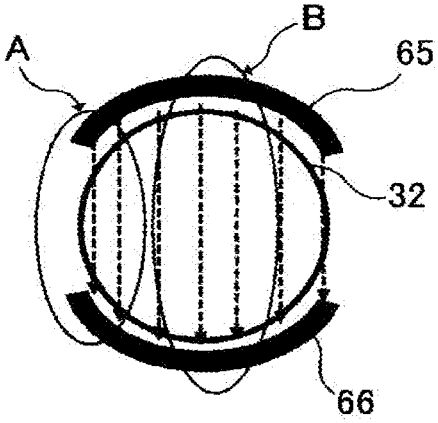

Since only one of the measuring electrodes 65 and 66 is arranged along the toner container 32, the distance between both ends of the upper and lower measuring electrodes 65 and 66 can be increased as compared with the case in which both of the measuring electrodes 65 and 66 are arranged along the toner container 32. In the case in which both of the measuring electrodes 65 and 66 are arranged along the toner container 32, as illustrated in FIG. 6B, lines of electric force are denser in an area A between the ends of the measuring electrodes 65 and 66 than lines of electric force in an area B between center portions of the measuring electrodes 65 and 66. This is because the distance between the ends of the measuring electrodes 65 and 66 is shorter than the distance between the center portions of the measuring electrodes 65 and 66. Therefore, when the toner container 32 rotates and toner T in the toner container 32 is unevenly distributed, for example, on the right side as illustrated in FIG. 6A, the capacitance is greater than that when the toner T is evenly distributed, causing the capacitance to vary widely.

Therefore, in the present embodiment, only one of the measuring electrode 65 and 66 is arranged along the toner container 32. As a result, the distance between both ends of the upper and lower measuring electrodes 65 and 66 can be increased, and the difference of the lines of electric force between the end and the center portion can be reduced. With this configuration, the difference of the capacitance is decreased between when the toner in the toner container 32 is unevenly distributed to the left or right and when the toner in the toner container 32 is evenly distributed, thereby improving the measurement accuracy.

Figure 7:
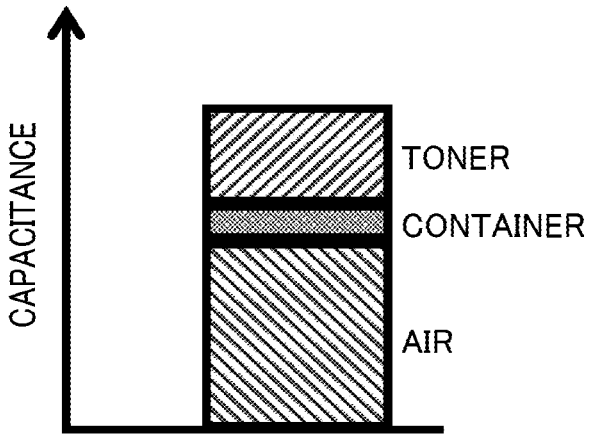
FIG. 7 is a graph illustrating an example of a ratio of effects of the toner container and toner on capacitance.

FIG. 7 is a graph illustrating an example of a ratio of effects of objects to be measured on the capacitance. As illustrated in FIG. 7, the objects to be measured between the measuring electrodes 65 and 66 are toner, the toner container 32, and air. A certain voltage is applied to the measuring electrode 65 and 66 to measure the capacitance. If the voltage varies, the capacitance also varies, and the amount of toner calculated from the capacitance also varies greatly. The variation of the amount of toner can be reduced by lowering the capacitance of the object other than the measurement target (i.e., toner) or by increasing the sensitivity of the measurement target (i.e., toner). One of the measuring electrodes 65 and 66 arranged along the toner container 32 can make the measurement region of air smaller and increase the sensitivity of the measurement target (i.e., toner) as compared with the case of the pair of flat electrodes, thereby improving the measurement accuracy.

For example, in the case of flat upper and lower electrodes, the calculated amount of toner varies as follows.

Capacitance:

Air (without the toner container 32 and toner): 3000 counts (79%)

Air and the toner container 32: 3100 counts

Air, the toner container 32, and toner: 3800 counts (100%)

Toner sensitivity of capacitance: 2.0 counts/g

If the voltage variation is ±0.5%, the amount of toner varies from ±7.8 g to 9.5 g.

On the other hand, in the case of a flat lower electrode and an arc-shaped upper electrode, the calculated amount of toner varies as follows.

Capacitance:

Air (without the toner container 32 and toner): 3500 counts (74%)

Air and the toner container 32: 3650 counts

Air, the toner container 32, and toner: 4700 counts (100%)

Toner sensitivity of capacitance: 3.0 counts/g

If the voltage variation is ±0.5%, the amount of toner varies from ±6.1 g to 7.8 g.

With the arc-shaped upper measuring electrode 65, the space between the upper and lower measuring electrodes 65 and 66 can be narrowed. Accordingly, the sensitivity of measuring capacitance is increased, so that the toner sensitivity is increased. Further, although the capacitance of only air increases, the ratio of the capacitance of air to the capacitance including the toner container 32 and toner decreases. As a result, the variation of the amount of toner can be reduced by ±1.7 g.

When the amount of toner in the toner container 32 is large, the difference of the variation of the capacitance between the flat electrode and the arc-shaped electrode is not large, but when the amount of toner is small, the difference of the variation is large. Therefore, the arc-shaped measuring electrode 65 is useful for detecting amount of toner because high detection accuracy is required when the amount of toner is small.

As illustrated in FIGS. 3A and 3B, each of the measuring electrodes 65 and 66 is connected to a capacitance detection circuit 111 included in a powder amount detection unit 110. The capacitance detection circuit 111 applies electric power to the pair of measuring electrodes 65 and 66, thereby detecting the capacitance between the pair of measuring electrodes 65 and 66. A known method of detecting capacitance can be used. In the present embodiment, a charging method is used in which the capacitance is measured by a relation between the time of charge arrival point and the voltage or current while a constant voltage or a constant current is applied between the pair of measuring electrodes 65 and 66.

The detection result obtained by the capacitance detection circuit 111 is transmitted to a toner amount calculation circuit 112, and a toner amount calculation circuit 112 calculates the amount of toner remaining in the toner container 32 based on the detected capacitance. The detected capacitance varies depending on a dielectric constant between the measuring electrodes 65 and 66. Toner has a higher dielectric constant than air. Therefore, the dielectric constant varies according to the amount of toner in an electric field between the measuring electrodes 65 and 66. As a result, the capacitance varies according to the amount of toner in the toner container 32 sandwiched by the pair of measuring electrodes 65 and 66. Thus, the amount of toner in the toner container 32 can be calculated by detecting the capacitance.

In the present embodiment, the toner amount calculation circuit 112 calculates the amount of toner remaining in the toner container 32 based on a calibration curve stored in a memory 113 and the capacitance obtained by the capacitance detection circuit 111. The calibration curve preliminarily acquired indicates the relation between the capacitance and the amount of toner in the toner container 32. A temperature and humidity sensor 114 is provided to detect temperature and humidity around the toner container 32, and the amount of toner remaining in the toner container 32 is corrected based on a detection result obtained by the temperature and humidity sensor 114. The amount of toner obtained by the toner amount calculation circuit 112 is displayed on a display 115 (e.g., a control panel).

As described above, in the present embodiment, a powder amount detector (a toner amount detector) includes the measuring electrodes 65 and 66 and the powder amount detection unit 110 including the capacitance detection circuit 111, the toner amount calculation circuit 112, the memory 113, the temperature and humidity sensor 114, and the display 115. In the present embodiment, the measuring electrodes 65 and 66 are disposed outboard of the toner container 32, thereby preventing toner from adhering to the measuring electrodes 65 and 66. Therefore, the amount of toner can be detected accurately. The number of components and the cost of the toner container 32 can be reduced. Under high temperature environment, the amount of toner remaining in the toner container 32 can be accurately detected without being affected by thermal expansion of the toner container 32.

With such a configuration in which the pair of measuring electrodes 65 and 66 sandwiches the toner container 32, the capacitance does not vary due to the shape error or rotational eccentricity of the toner container 32. Therefore, the amount of toner remaining in the toner container 32 can be detected accurately. In the present embodiment, the pair of measuring electrodes 65 and 66 covers almost the entire toner container 32. Specifically, the projection areas of the measuring electrodes 65 and 66 projected on the horizontal plane by the projection light L1 directed in the vertical direction include the projection area of the toner container 32. With this configuration, since almost all toner in the toner container 32 is included in the lines of electric force between the pair of measuring electrodes 65 and 66 (i.e., electric field), the amount of toner remaining in the toner container 32 can be detected accurately even if the toner is unevenly distributed in the toner container 32, and the accurate amount of toner remaining in the toner container 32 can be reported to a user.

Figure 8:
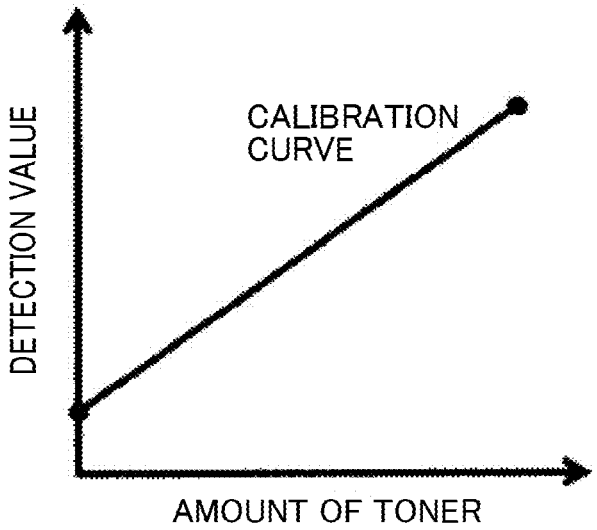
FIG. 8 is a graph illustrating an example of a calibration curve.

FIG. 8 is a graph illustrating an example of the relation between the amount of toner in the toner container 32 and the capacitance. As illustrated in FIG. 8, the relation between the amount of toner in the toner container 32 and the capacitance is approximately linear. Therefore, the amount of toner remaining in the toner container 32 can be accurately calculated based on the capacitance. A distance between the measuring electrodes 65 and 66 may be different for each device due to assembly tolerances. Therefore, in the present embodiment, the powder amount detector employs a calibration curve calculation mode to acquire the calibration curve as illustrated in FIG. 8. Before factory shipment, the calibration curve calculation is performed, and the calibration curve is acquired and stored in the memory 113. The calibration curve calculation can be performed by a certain operation on the display 115 (e.g., the control panel) of the printer 100 as the image forming apparatus.

As the calibration curve calculation starts, the controller 150 causes the display 115 to display an instruction to install an empty toner container 32 in the toner container mount 70. After setting the empty toner container 32 in the toner container mount 70, an operator operates the display 115, for example, pushes a start button, thereby measuring capacitance. After measuring the capacitance of the empty toner container 32, the controller 150 causes the display 115 to display an instruction to install a full toner container 32 in the toner container mount 70. After setting the full toner container 32 in the toner container mount 70, the operator operates the display 115, thereby measuring capacitance. After measuring the capacitance of the full toner container 32, the controller 150 acquires a calibration curve based on the capacitances of the empty and full toner containers 32 and stores the calibration curve in the memory 113. The calibration curve calculation is performed for each color of Y, M, C, and K.

Alternatively, the controller 150 may acquire a calibration curve based on capacitance of a toner container 32 containing a small amount of toner instead of the empty toner container 32 or capacitance without the toner container 32, and the capacitance of the full toner container 32. That is, the capacitance between the pair of measuring electrodes 65 and 66 is measured in at least two states in which the amount of toner between the pair of measuring electrodes 65 and 66 is different from each other to acquire the calibration curve. Further, the calibration curve may be acquired by an imitation of the toner container 32 in which an amount of material, such as an acrylonitrile-butadiene-styrene (ABS) resin, is adjusted so as to have the capacitance identical to that of the toner container 32. As described above, the controller 150 performs the calibration curve calculation.

In the present embodiment, the temperature and humidity sensor 114 is provided to detect temperature and humidity around the toner container 32, and the amount of toner is corrected based on a detection result obtained by the temperature and humidity sensor 114. This is because the distance between the measuring electrodes 65 and 66 varies due to the thermal expansion of components to which the measuring electrodes 65 and 66 are secured (i.e., components constructing the upper and lower walls 67 and 68). Further, moisture between the measuring electrodes 65 and 66 varies. As a result, the capacitance between the measuring electrodes 65 and 66 varies.

The temperature and humidity at the time of measuring the above-described calibration curve are stored in the memory 113, and the amount of toner is corrected according to the difference of temperature and humidity between at the time of measuring the capacitance of the toner container 32 actually used and at the time of measuring the calibration curve in consideration of a predetermined temperature and humidity correction factor. As a result, the calculation error of the amount of toner due to ambient temperature and humidity is minimized, thereby acquiring the amount of toner accurately.

For example, a correction factor $\alpha$ at high temperature and high humidity and a correction factor $\beta$ at low temperature and low humidity are stored in the memory 113. If temperature and humidity detected by the temperature and humidity sensor 114 are equal to or higher than a predetermined first threshold, the amount of toner is corrected by multiplying the calculated amount of toner by the correction factor $\alpha$ at high temperature and high humidity. If temperature and humidity detected by the temperature and humidity sensor 114 are equal to or less than a second threshold which is lower than the first threshold, the amount of toner is corrected by multiplying the calculated amount of toner by the correction factor $\beta$ at low temperature and low humidity. As a result, the calculation error of the amount of toner due to ambient temperature and humidity is minimized, thereby acquiring the amount of toner accurately. As described above, the calculated amount of toner is corrected according to temperature and humidity, but alternatively, the detected capacitance can be corrected according to temperature and humidity.

Figure 9:
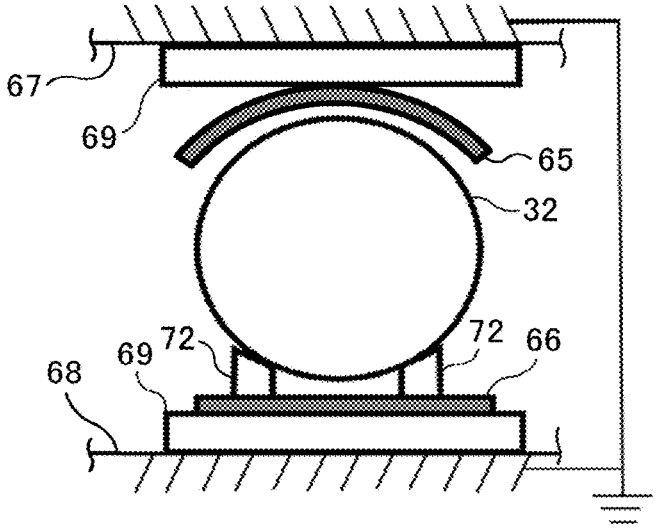
FIG. 9 is a schematic cross-sectional view of an example of the toner supply device provided with ground electrodes disposed outboard of measuring electrodes according to an embodiment of the present disclosure.

FIG. 9 is a schematic cross-sectional view of an example of a toner supply device 60 provided with ground electrodes disposed outboard of the measuring electrodes 65 and 66. As illustrated in FIG. 9, the measuring electrodes 65 and 66 are attached to the upper and lower walls 67 and 68 via insulators 69. Components constructing the upper and lower walls 67 and 68 are electrically grounded, thereby functioning as ground electrodes. As illustrated in FIG. 1, the photoconductors 1, the charging devices 4 (see FIG. 2), the intermediate transfer unit 15, and the like are disposed below the toner containers 32. This configuration may cause capacitance to vary. In the present embodiment, since the component constructing the lower wall 68 is electrically grounded as the ground electrode, electrical noises from the photoconductors 1, the charging devices 4, and the intermediate transfer unit 15 can be cut off. Above the toner containers 32, the printed recording media P are stacked, the control panel is disposed, and an operator may put the hand on the stack tray 30. This configuration may cause capacitance to vary. In the present embodiment, since the component constructing the upper wall 67 is electrically grounded as the ground electrode, electrical noises from above can be cut off. Therefore, the variation of capacitance due to the electrical noises can be minimized, and the amount of toner can be accurately detected. Note that, preferably, the ground electrodes (i.e., the upper and lower walls 67 and 68) are larger than the measuring electrodes 65 and 66, and cover the measuring electrodes 65 and 66 as viewed from the ground electrodes (i.e., the upper and lower walls 67 and 68).

Figure 10:
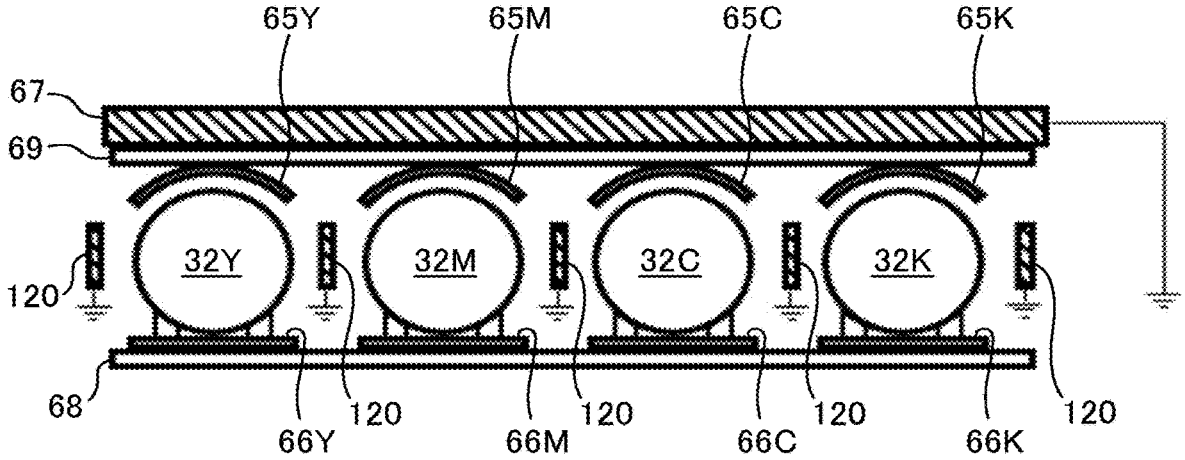
FIG. 10 is a schematic cross-sectional view of an example of the toner supply devices provided with ground electrodes between adjacent toner containers according to an embodiment of the present disclosure.

FIG. 10 is a schematic cross-sectional view of an example of a plurality of toner supply devices 60 provided with a plurality of ground electrodes 120 that partition a plurality of toner containers 32Y, 32M, 32C, and 32K disposed adjacent to each other. Without the ground electrodes 120, some of the lines of electric force between the measuring electrodes 65 and 66 (i.e., the lines of electric force near the adjacent toner container 32) may be changed due to toner in the adjacent toner container 32. That is, current may flow through the toner in the adjacent toner container 32. As a result, the capacitance may vary according to the amount of toner in the adjacent toner container 32, and the amount of toner may not be accurately detected.

However, as illustrated in FIG. 10, since the ground electrodes 120 partition the adjacent toner containers 32, the lines of electric force between the measuring electrodes 65 (65Y, 65M, 65C, and 65K) and 66 (66Y, 66M, 66C, and 66K) are cut off by the ground electrodes 120. That is, some of the lines of electric force between the measuring electrodes 65 and 66 is directed toward the ground electrode 120 but does not go to the adjacent toner container 32 beyond the ground electrode 120. Therefore, this configuration can prevent the capacitance to be detected from being affected by the amount of toner in the adjacent toner container 32, and the amount of toner can be accurately detected.

In addition to the ground electrodes 120 on the left and right side in FIG. 10, ground electrodes 120 may be disposed in the direction perpendicular to the surface of the paper on which FIG. 10 is drawn so as to surround the four toner containers 32Y, 32M, 32C, and 32K. Therefore, the ground electrodes 120 can cut off electrical noises caused by human passing by or another device disposed on the side, front, or back of the printer 100, and the amount of toner can be more accurately detected.

In the example in FIG. 10, the component constructing the lower wall 68 is not electrically grounded as a ground electrode, and the insulator 69 is not provided, but the lower wall 68 may functions as a ground electrode similarly to the upper wall 67 in another example. Conversely, in yet another example, only the lower wall 68 may functions as a ground electrode, and the upper wall 67 may not function as a ground electrode.

In the above-described embodiments, the measuring electrodes 65 and 66, one of which has the flat shape and the other of which has the arc shape following the shape of the powder container 32, are arranged vertically, but, alternatively, measuring electrodes may be arranged horizontally.

As described above, according to the present disclosure, a powder amount detector can accurately detect an amount of powder.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A powder amount detector configured to detect an amount of powder in a powder container of a cylindrical shape arranged horizontally, the powder amount detector comprising:

a pair of measuring electrodes configured to detect capacitance between the pair of measuring electrodes to detect the amount of powder, the pair of measuring electrodes disposed outside the powder container, one of the pair of measuring electrodes having a flat shape, and another of the pair of measuring electrodes having an arc shape following a shape of the powder container.

2. The powder amount detector according to claim 1, wherein the pair of measuring electrodes is arranged below and above the powder container in a vertical direction.

3. The powder amount detector according to claim 2, wherein projected areas of the pair of measuring electrodes projected in the vertical direction have a same size.

4. The powder amount detector according to claim 1, further comprising ground electrodes disposed outboard of the pair of measuring electrodes and grounded electrically.

5. The powder amount detector according to claim 1, further comprising a memory to store a calibration curve indicating a relation between the capacitance between the pair of measuring electrodes and the amount of powder in the powder container, wherein the powder amount detector is further configured to detect the amount of powder in the powder container based on the calibration curve and the capacitance between the pair of measuring electrodes, and wherein the powder amount detector is further configured to measure the capacitance between the pair of measuring electrodes in at least two states in which the amount of powder between the pair of measuring electrodes is different from each other to acquire the calibration curve.

6. The powder amount detector according to claim 1, further comprising:

a memory to store a calibration curve indicating a relation between the capacitance between the pair of measuring electrodes and the amount of powder in the powder container; and a temperature and humidity sensor configured to detect temperature and humidity, wherein the powder amount detector is further configured to detect the amount of powder in the powder container based on the calibration curve, the capacitance between the pair of measuring electrodes, and the temperature and humidity detected by the temperature and humidity sensor.

7. A powder supply device comprising:

the powder amount detector according to claim 1; and the powder container, wherein the powder supply device is configured to supply powder in the powder container.

8. The powder supply device according to claim 7, further comprising a rotary drive device configured to rotate the powder container.

9. The powder supply device according to claim 7, further comprising a plurality of powder containers, including the powder container, arranged in parallel;

a plurality of powder amount detectors, including the powder amount detector, provided corresponding to the plurality of powder containers, respectively; and a plurality of ground electrodes disposed between the plurality of powder containers and electrically grounded.

10. An image forming apparatus comprising:

an image bearer configured to bear a latent image;

a developing device configured to develop the latent image on the image bearer with a developer;

the powder container configured to contain the developer to be used in the developing device; and the powder supply device according to claim 7 configured to supply the developer in the powder container to the developing device.

11. The powder supply device of claim 7, wherein the pair of measuring electrodes is arranged below and above the powder container in a vertical direction.

12. The powder supply device of claim 11, wherein projected areas of the pair of measuring electrodes projected in the vertical direction have a same size.

13. The image forming apparatus of claim 10, wherein the pair of measuring electrodes is arranged below and above the powder container in a vertical direction.

14. The image forming apparatus of claim 13, wherein projected areas of the pair of measuring electrodes projected in the vertical direction have a same size.

* * * * *